US005553554A

United States Patent [19]

Urich, Jr.

[11] Patent Number: 5,553,554

[45] Date of Patent: Sep. 10, 1996

[54] WASTE DISPOSAL AND ENERGY RECOVERY SYSTEM AND METHOD

[76] Inventor: Albert E. Urich, Jr., 4731 N. Oakland Ave., Whitefish Bay, Wis. 53211

[21] Appl. No.: 317,904

[22] Filed: Oct. 4, 1994

[51] Int. Cl.[6] ..... F23B 5/00

[52] U.S. Cl. ..... 110/211; 110/210; 110/234; 110/246

[58] Field of Search ..... 110/210, 211, 110/234, 246

[56] References Cited

U.S. PATENT DOCUMENTS

| | | | |
|---|---|---|---|
| 2,107,507 | 2/1938 | Rose | 110/246 |
| 3,705,711 | 12/1972 | Seelandt et al. | 110/246 |
| 4,356,778 | 11/1982 | McRee Jr. | 110/234 |
| 4,734,166 | 3/1988 | Angelo II | 110/246 |
| 4,922,838 | 5/1990 | Keller et al. | 110/234 |
| 5,018,459 | 5/1991 | Judd . | |

OTHER PUBLICATIONS

Cleaver Brooks brochure entitled Rotary Kiln Thermal Processing Systems, 1987.

Zurn brochure entitled the Pathways to Steam, pp. 12–13, admitted prior art.

*Primary Examiner*—Thomas E. Denion

*Attorney, Agent, or Firm*—Andrus, Sceales, Starke & Sawall

[57] ABSTRACT

A waste disposal and energy recovery system and method uses sub-stoichiometric combustion to gasify waste fuels into high temperature synthetic gas. The system minimizes the amount of flue gas exiting to the atmosphere. The high temperature synthetic gas is then combusted in a gas burner. The burner can be closely coupled to a heat recovery unit to facilitate radiative heat transfer. Some flue gas can be recirculated to maintain low combustion temperatures in both the kiln and the burner. Sub-stoichiometric combustion is accomplished in the rotary kiln in a counterflow configuration.

27 Claims, 3 Drawing Sheets

WASTE DISPOSAL AND ENERGY RECOVERY SYSTEM AND METHOD

FIELD OF THE INVENTION

The invention relates to recovering energy from non-conventional fuels, such as waste sludges, biomass, or other low quality fuels. The invention reduces the volume of disposable waste, and also reduces associated environmental problems such as siting new landfills. The invention is preferably used either on-site where waste products are generated, or at a landfill where waste products have been disposed.

BACKGROUND OF THE INVENTION

Commercially available systems that recover energy from waste products frequently use a rotary kiln in which waste fuel is combusted under excess air conditions. In these rotary kiln systems, more than twice the stoichiometric amount of air is frequently supplied to the rotary kiln to ensure complete combustion of the waste fuel. The excess-air rotary kiln systems can completely combust virtually any kind of fuel because the fuel is turned over repeatedly. Rotary kiln systems can effectively burn carbohydrates, hydrocarbons and even hard to burn fixed carbon. A typical rotary kiln might have a 12 foot diameter, a 55 foot length.

In excess-air rotary kiln systems, almost all of the combustion takes place in the rotary kiln, but a secondary combustion chamber is needed to complete combustion of unburned products in the flue gas, such as carbon monoxide, unburned hydrocarbons or particulate matter. The temperature of combustion gases in the secondary combustion chamber is typically between 1,800°–2,200° F. A supplemental fuel such as natural gas or fuel oil is used to ensure complete combustion in the secondary combustion chamber. Hot combustion gases from the secondary combustion chamber are normally ducted to a heat recovery boiler where useful energy is recovered in the form of steam. The flue gas is then discharged through an air pollution control device (APCD) and a stack to the atmosphere. An induced draft fan draws air and flue gases through the entire system.

Waste fuel can be provided to the rotary kiln in a batch manner using a ram feeder, in a continuous manner using augers, or in many other ways known in the art. The rotary kiln is typically ignited with a start up burner that can sometimes be used as a supplemental burner to burn supplemental fuels, such as natural gas, fuel oil, propane, or the like.

The rotary kiln is slightly inclined so that the fuel feed end in which the waste fuel is introduced is slightly higher than the ash discharge end from which combustion ash is discharged. One advantage of rotary kilns is that lime can be injected into the kiln to provide for in-bed scrubbing for $SO_x$. In the prior art, combustion air is introduced into the rotary kiln through the fuel feed end, and the hot combustion gases are ducted from the ash discharge end of the rotary kiln to the secondary combustion chamber. The fuel and combustion air, thus, flow in a co-current configuration.

The induced fan is set to draw excess air into the rotary kiln (i.e., about twice the stoichiometric amount for combustion in the kiln). A substantial amount of flue gas is thus discharged to the atmosphere, and most of the flue gas is nitrogen. The temperature of the flue gas exiting the stack is typically at least 400° F., and represents a significant loss of energy to the atmosphere. A conventional excess-air rotary kiln system can recover in the form of steam about 60–65% of the heating value in the waste fuel.

SUMMARY OF THE INVENTION

The invention is a system and a method for recovering energy from waste fuels in which a waste fuel is converted to a high temperature synthetic gas through sub-stoichiometric combustion, and the high temperature synthetic gas is then fully combusted elsewhere. The sub-stoichiometric partial combustion of the waste fuel is accomplished within a gasification chamber in a rotating kiln. A gas burner can then be used to efficiently burn the high temperature synthetic gas produced in the gasification chamber in the kiln.

The invention optimizes kiln productivity by using the kiln to gasify waste fuel, but not fully combusting the waste fuel. The system thus has a higher capacity in terms of Btuh heat release than an excess-air system using a kiln that is the same size.

It is preferred that 35–60% of the stoichiometric amount of combustion air be supplied to the gasification chamber in the kiln. The amount of combustion air provided to the burner is preferably the stoichiometric amount of air to combust the high temperature synthetic gas plus an additional amount of air to ensure proper mixing and complete combustion. Thus, compared to an excess-air system, the invention reduces the total flow of flue gas through the system and into the atmosphere. This reduces heat losses. The preferred system can recover in the form of steam up to 80% of the heating value in the waste fuel. Also, the size of system components such as air pollution control devices, induced and forced draft fans, ductwork, dampers, and the like can be reduced because of the reduced flow through the system.

It is preferred that lifting flights be located on the inner surface of the rotary kiln to help turnover and mix solid waste fuel. The invention thus maintains the primary advantage of rotary kilns which is the ability to accept and fully combust a wide variety of waste fuels. The invention also maintains the ability to provide for in-bed scrubbing for $SO_x$.

Another advantage with sub-stoichiometric combustion in the rotary kiln is that the temperature in the kiln is typically lower and more easily controlled than in excess-air systems. The lower kiln temperature improves the durability of the kiln, and also reduces the formation of $NO_x$ and other pollutants within the kiln. In accordance with the invention, the kiln temperature can be further controlled by injecting recirculated flue gas having little or no oxygen into the kiln.

In another aspect of the invention, the gas burner in which the high temperature synthetic gas is combusted is closely coupled to a heat recovery unit. The preferred heat recovery unit is a water tube style steam or hot water generator. By closely coupling such a heat recovery unit to the burner, heat energy can be efficiently transferred from the combustion products of the burner into useful energy. The water tube steam or hot water generator is preferred because it can be coupled close enough to the burner so that much of the heat energy from the combustion products of the burner can be transferred via radiation, which is a highly effective means of heat transfer.

Recirculated flue gas can also be introduced to the burner to ensure that the flame temperature produced by the burner is low enough to discourage the formation of $NO_x$.

The preferred embodiment of the invention uses a counterflow configuration in the kiln gasification chamber. Waste fuel is introduced into the gasification chamber at one end of the kiln and ash is discharged from the other end of the kiln. The sub-stoichiometric amount of combustion air is introduced at the ash discharge end of the kiln and high temperature synthetic gas is ducted from the kiln at the fuel feed end of the kiln. The primary combustible component in the synthetic gas is expected to be carbon monoxide. The counterflow configuration facilitates efficient gasification within the kiln. Easy to burn combustibles located towards the fuel feed end of the kiln are under extremely starved air conditions, while excess air conditions are present at the ash discharge end of the kiln where hard to burn combustibles may still be present. Combustion control lances can be used to inject additional fuel, combustion air, flue gas, water or anything else at specific locations in the kiln to modify gasification.

DETAILED DESCRIPTION OF THE PREFERRED EMBODIMENT

Figure 1:
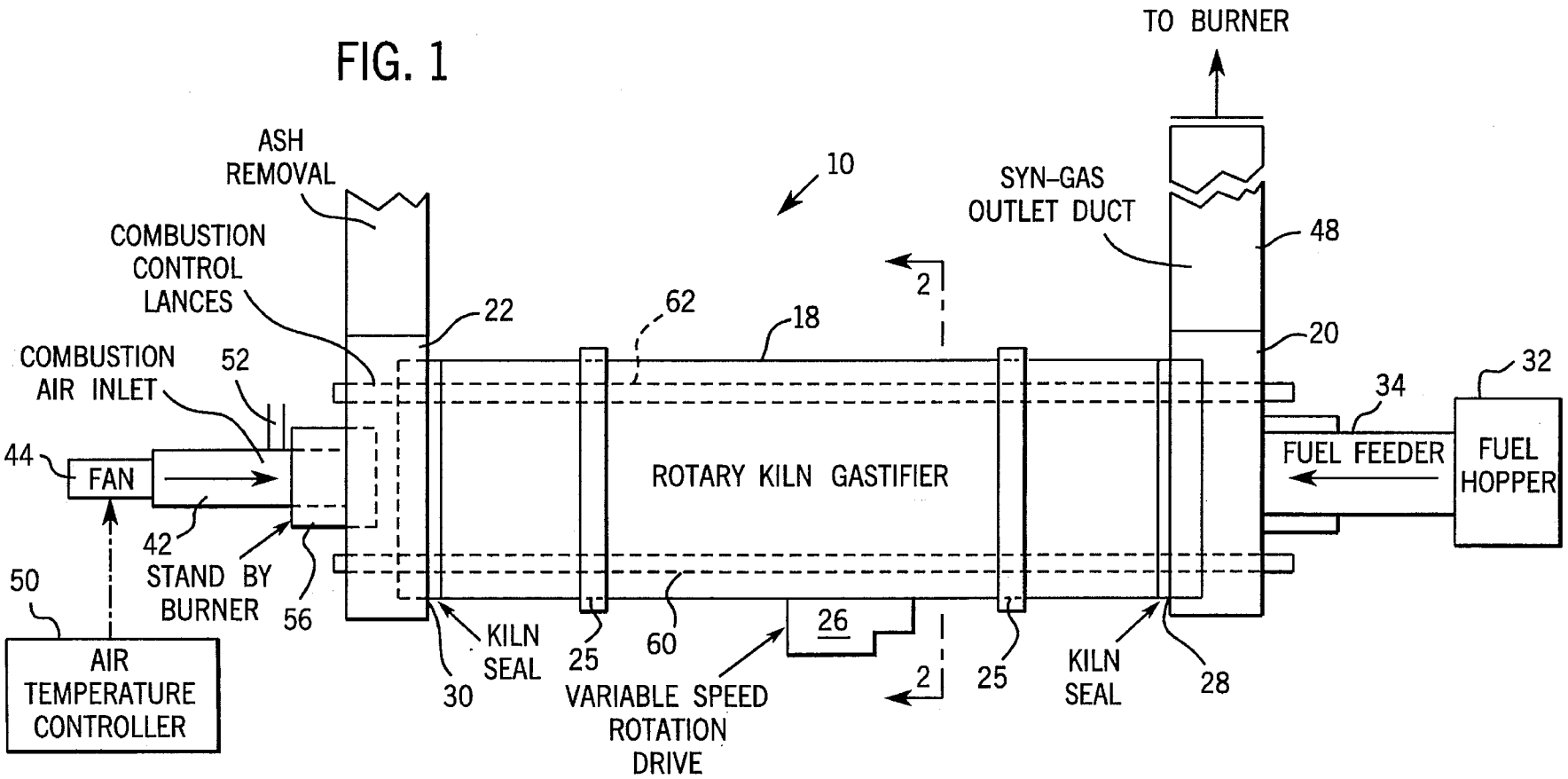
FIG. 1 is a top view of a rotary gasification kiln in a counterflow configuration in accordance with the preferred embodiment of the invention.
Figure 2A:
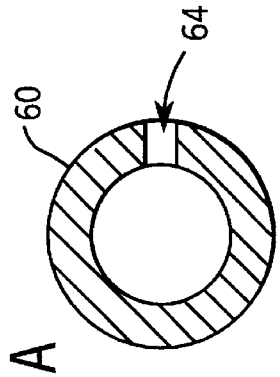
FIG. 2A is a detailed cross sectional view of a combustion control lance as is depicted within the rotary kiln shown in FIG. 2.
Figure 2:
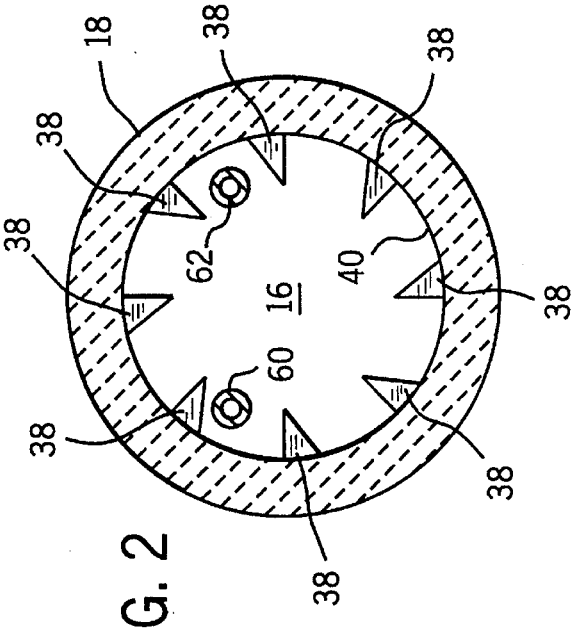
FIG. 2 is a cross sectional view of the rotary kiln taken along line 2—2 in FIG. 1.
Figure 3:
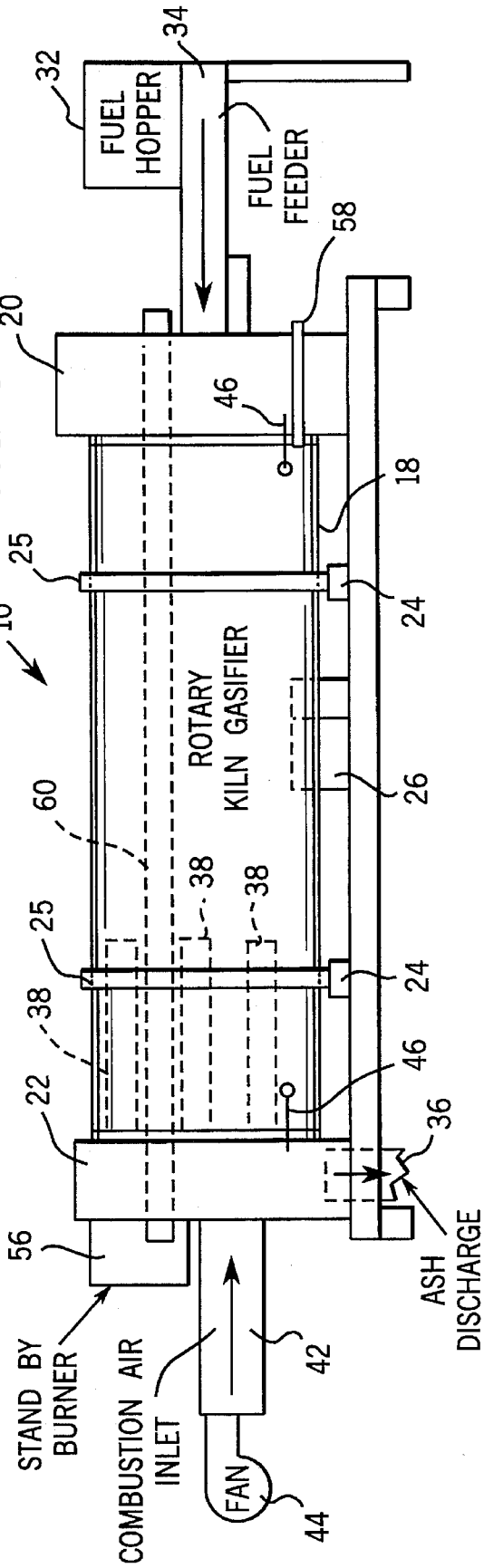
FIG. 3 is a side view of the rotary kiln shown in FIG. 1.

The drawings show the preferred waste fuel energy recovery system for implementing a two-step combustion process in accordance with the invention. The system includes a rotary kiln gasifier 10 that produces high temperature synthetic gas from waste fuel, a gas burner 12 that mixes the synthetic gas from the kiln 10 with combustion air and ignites the mixture, and a heat recovery unit 14 that is preferably a water tube style generator closely coupled to the burner 12. Referring to FIGS. 1–3, the rotary kiln gasifier 10 has a gasification chamber 16 located within a generally cylindrical kiln wall 18 that has open ends. The kiln wall 18 is received by two end panels: a fuel feed end panel 20 and an ash discharge end panel 22. The end panels 20 and 22 each have a cavity within, and an opening on the inside surface of the panel to receive the cylindrical kiln wall 18. Bearing supports 24 are located between the end panels 20 and 22 to support riding rings 25 which are attached to the kiln wall 18. A variable speed drive 26 is provided to rotate the cylindrical kiln wall 18 upon the bearings of the bearing supports 24. A kiln seal 28 seals the opening in the fuel feed end panel 20 in which the kiln wall 18 is received. Another kiln seal 30 is located in the opening of the ash discharge end panel 22 in which the kiln wall 18 is received.

A fuel hopper 32 is provided to store waste fuel. The rotary kiln gasifier 10 can accept a variety of waste fuels such as wood processing waste, municipal or papermill sludges, many other biomass waste products, or other low quality fuels. Lime can be mixed with the fuel in the fuel hopper 32 so that in-bed scrubbing of $SO_x$ can occur within the gasification chamber 16. Alternatively, lime can be injected directly into the gasification chamber 16. A fuel feeder 34 supplies waste fuel from the fuel hopper 32 through the fuel feed end panel 20 into the gasification chamber 16. The fuel feeder 34 can be a ram feeder for batch processing or an auger feeder for continuously feeding the fuel into the gasification chamber 16. Other types of feeders 34 can also be used as is known in the art. Additional fuel hoppers and fuel feeders may be used to supply additional types of waste fuel through the fuel feed end panel 20 into the gasification chamber 16. A fluid waste fuel port 58 can also be provided through the fuel feed end panel 20 so that liquid or gaseous waste fuels can be provided into the gasification chamber 16.

Referring in particular to FIG. 3, the cylindrical kiln wall 18 tilts so that the end of the kiln 18 at the fuel feed end panel 20 is higher than the end of the kiln 18 at the ash discharge end panel 22. When the variable speed drive 26 rotates the kiln wall 18, fuel which is introduced into the gasification chamber 16 by the fuel feeder 34 migrates from the end of the gasification channel near the fuel feed end panel 20 towards the end of the gasification chamber near ash discharge end panel 22. When the remaining solids in the fuel are fully combusted, the remaining ash is discharged through an ash discharge 36 located through the bottom of the ash discharge end panel 22. The ash can be recycled into certain manufacturing products, or can be disposed in a landfill. Even if the ash is disposed in a landfill, the invention has the benefit of greatly reducing the volume that needs to be disposed.

Referring to FIG. 2, lifting flights 38 extend inward from an inside surface 40 of the kiln wall 18 on a portion of the kiln wall 18 that is located by the ash discharge end panel 22. There are preferably several lifting flights 38 located around the inside circumference 40 of the kiln wall 18. The lifting flights 38 facilitate mixing of combustion air with the fuel-ash mixture that has migrated to that part of the gasification chamber 16.

Referring again to FIG. 3, combustion air inlet 42 introduces combustion air through the ash discharge end panel 22 into the gasification chamber 16. A fan 44 supplies air to the inlet 42 and regulates the amount of combustion air introduced to the gasification chamber 16. In order to gasify the waste fuel, a sub-stoichiometric amount of combustion air is supplied into the gasification chamber 16. It is preferred that about 35–60% of the stoichiometric amount of oxygen be supplied to the rotary kiln gasifier 10.

It is well known that combustion flame temperatures for a given fuel peak under stoichiometric conditions. A relationship of the fuel to air ratio versus combustion temperature within the gasification chamber 16 can be obtained for the specific waste fuel type being supplied to the system. One or more temperature sensors 46 can be located throughout the gasification chamber 16 to monitor the temperature in the gasification chamber 16. The amount of combustion air supplied by the fan 44 can be adjusted in response to the temperature in the gasification chamber 16 to maintain an overall average of 35–60% sub-stoichiometric conditions. The temperature within the gasification chamber 16 should be maintained between 1100° F.–1500° F., and preferably between 1200° F.–1400° F.

An air temperature controller 50 receives temperature signals from the one or more temperature sensors 46 and controls the speed and/or the damper of the fan 44 which in turn regulates the amount of combustion air introduced into the gasification chamber 16. A flue gas inlet 52 allows some of the flue gas exiting the heat recovery unit to be recirculated and introduced into the gasification chamber 16 with the combustion air. The recirculated flue gas has little or no oxygen and thus lowers the temperature within the gasification chamber 16.

Combustion air flows through the gasification chamber 16 starting at the combustion air inlet 42 by the ash discharge end panel 22 and high temperature synthetic gas flows out through the fuel feed end panel 20 via a synthetic gas outlet duct 48. The combustion air and the waste fuel are thus in a counterflow configuration. When the combustion air first enters the gasification chamber 16 the air reacts with combustibles remaining in the fuel-ash mixture at the end of the combustion chamber 16 located near the ash discharge end panel 22. Reaction of these hard to burn combustibles near the combustion air inlet 42 is promoted by locally excess air conditions in that portion of the gasification chamber 16, and also by thorough mixing that is facilitated by the lifting flights 38. While the local conditions in the gasification chamber 16 near the combustion air inlet 42 are excess air conditions, starved air conditions are present through most of the gasification chamber 16. Extremely starved air conditions are present in the portions of the gasification chamber located near the fuel feed end panel 20. Thus, volatile combustibles can be gasified under extremely starved air conditions, while harder to burn combustibles are exposed to more oxygen to promote oxidation.

The high temperature synthetic gas exiting the gasification chamber 16 through the synthetic gas outlet duct 48 includes carbon monoxide as the primary combustible component along with water, nitrogen, some carbon dioxide and perhaps small amounts of other elements such as particulates or unburned materials. The high temperature synthetic gas exiting through the synthetic outlet duct 48 is at 1200° F.–1400° F. in a preferred system. The formation of $NO_x$ is discouraged in the gasification chamber 16 because of the relatively low temperatures therein. The heating value of the high temperature synthetic gas will generally be between 200–400 BTUs per cubic feet compared to 1,000 BTUs per cubic feet for natural gas. The high temperature synthetic gas, however, contains a significant amount of energy in the form of heat because the synthetic gas is at 1200° F.– 1400° F.

A standby burner 56 is mounted to the ash discharge end panel 22 for burning a supplemental liquid or gaseous fuel. The standby burner 56 can be used to supplement combustion in the gasification chamber 16 to maintain minimum desired operating temperature; and to also pre-heat the gasification chamber 16 to a minimum desired operation temperature.

Combustion control lances 60 and 62 can extend through each end panel 20 and 22 and span across the gasification chamber 16. While the drawings show the combustion control lancers 60 and 62 spanning through the combustion chamber 16 between the end panels 20 and 22, it may be preferred in some applications that the lances 60 and 62 be merely cantilevered. Fuel, air, recirculated flue gases, water, or some other composition can be injected through the combustion control lances 60 and 62 to a specific location within the gasification chamber 16. Referring in particular to FIGS. 2 and 2A, the combustion control lances 60 and 62 are preferably a metal tube having a diameter of 1"–4", with one or more perforations 64 through the tube 60 wall. The one or more perforations 64 can be placed strategically to improve gasification at various locations within the kiln gasification chamber 16. For instance, it may be useful to provide combustion air through the lances 60 and 62 in such a manner that there is a sufficient amount of oxygen present locally to promote gasification, but not enough oxygen present locally to fully combust carbon monoxide into carbon dioxide. It is contemplated that there may be more than two combustion control lances, and that different compositions or mixtures can be injected through separate lances 60 or 62 to best facilitate efficient gasification, or otherwise control the process in the gasification chamber 16.

Figure 4:
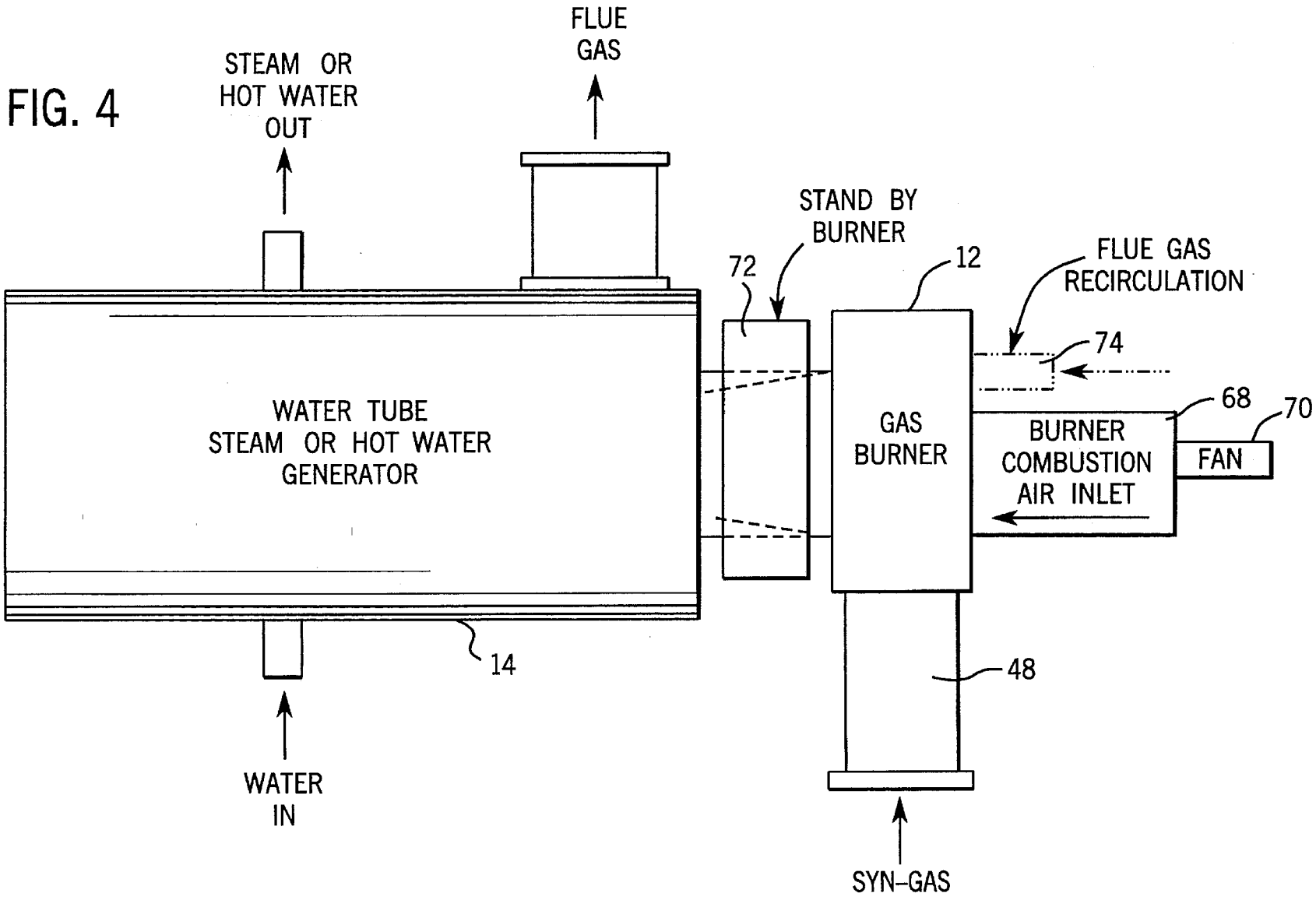
FIG. 4 is a schematic view of a part of the preferred energy recovery system that is located downstream of the rotary kiln shown in FIGS. 1–3.

Referring to FIG. 4, the high temperature synthetic gas exiting the gasification chamber 16 through the synthetic gas outlet duct 48 is supplied to the gas burner 12 to complete combustion of the synthetic gas. Combustion air is supplied to the gas burner 12 through a burner combustion air inlet 68. A burner fan 70 supplies combustion air through the burner combustion air inlet 68 to the gas burner 12. The fan 70 can be controlled to regulate the amount of combustion air introduced to the gas burner 12. It is preferred that a stoichiometric amount of combustion air be supplied to the gas burner plus an additional amount to ensure complete combustion of the high temperature synthetic gas. The burner 12 should be able to sufficiently mix the high temperature synthetic gas and the combustion air to provide for complete combustion. When the high temperature synthetic gas combusts with the combustion air, combustion products are formed. The combustion products primarily include hot flue gas and radiant energy.

The gas burner 12 is closely coupled to a heat recovery unit 14. The preferred heat recovery unit 14 is a water tube style steam generator, or alternatively a water tube style hot water generator. The preferred steam generator 14 receives water that flows through a series of tubes within a furnace chamber in the generator 14.

The flame produced by the gas burner 12 can become as hot as 2000° F.–2500° F., and is directed into the furnace chamber within the steam generator 14. A standby burner 72 can be provided in addition to the gas burner 12, and would be mounted directly to the heat recovery unit 14. The standby burner 72 can burn a supplemental fuel, if desirable. Heat is transferred from the combustion products to the water within the tubes of the steam generator 14 and steam is output from the steam generator 14. Close coupling the gas burner 12 to the preferred steam generator 14 allows for a significant amount of heat to be transferred through radiation and is therefore an exceptionally effective means of transferring heat. The combustion products from the gas burner 12 (and from the standby burner 72, if desired) are cooled in the steam generator 14, and exit the steam generator as flue gas at about 400° F. An induced draft fan draws flue gases from the steam generator 14, and also synthetic gas from the gasification chamber 16. Most of the flue gas would normally pass through an air pollution control device and out the stack to the atmosphere, but some of the flue gas can be recirculated into the system to lower combustion temperatures. Recirculated flue gas can be supplied to the gas burner 12 through a burner flue gas inlet 74. Recirculated flue gas can be supplied to the kiln 10 through the gasifier flue gas inlet 52 as explained above.

It should be appreciated that the overall system including the rotary kiln gasifier 10 and the gas burner 12 use very little excess air to fully combust the waste fuel (i.e. preferably 10–15% excess air for full combustion). Thus, the amount of flue gas exiting to the atmosphere and the associated heat loss is substantially less than the conventional excess-air rotary kiln systems.

The system shown in the drawings is a preferred embodiment of the invention, but the invention is not limited thereto. Various equivalents may be apparent to those skilled in the art and should be construed to be within the scope of the following claims.

I claim:

1. A method of recovering energy from waste fuels comprising the steps of:

introducing waste fuel into a rotating kiln from a first end of the kiln;

flowing a sub-stoichiometric amount of combustion air into the rotating kiln from a second end of the kiln that is lower than the first end of the kiln;

partially combusting the waste fuel in the kiln with the combustion air in the kiln to generate a high temperature synthetic gas by rotating the kiln so that the waste fuel gradually migrates downhill from the first end of the kiln to the second end of the kiln, the fuel initially reacting with air to form high temperature synthetic gas and a fuel-ash mixture, and by actively mixing combustion air with the fuel-ash mixture exclusively in a portion of the kiln located by the second end of the kiln to enhance reaction of fuel in the fuel-ash mixture with air to form high temperature synthetic gas and other products of combustion;

allowing the high temperature synthetic gas to exit through an outlet duct in the kiln; and combusting the high temperature synthetic gas from the outlet duct in the kiln to form combustion products including flue gas; and recovering heat energy from the combustion products.

2. A method as recited in claim 1 further comprising the step of introducing steam into the kiln when combusting waste fuel in the kiln.

3. A method as recited in claim 1 further comprising the step of introducing at least some of the flue gas into the kiln when the waste fuel is combusted with the combustion air.

4. A method as recited in claim 3 wherein at least some of the flue gas that is introduced into the kiln is introduced at one or more predetermined locations within the kiln.

5. A method as recited in claim 1 further comprising the step of introducing additional combustion air into the kiln at one or more predetermined locations.

6. A method as recited in claim 1 wherein the kiln is rotated at a variable speed when combusting the waste fuel in the kiln with the combustion air.

7. A method as recited in claim 1 wherein the high temperature synthetic gas is mixed with the combustion air in a burner for combustion, and the method further comprises the step of introducing at least some recirculated flue gas to the burner so that the high temperature synthetic gas, combustion air and recirculated flue gas are mixed in the burner.

8. A method as recited in claim 1 further comprising the step of introducing a supplemental fuel into the kiln when combusting the waste fuel in the kiln.

9. A method as recited in claim 1 wherein the high temperature synthetic gas is mixed with the combustion air in a burner for combustion, and the method further comprises the step of introducing a supplemental fuel to the burner when mixing the high temperature synthetic gas with the combustion air in the burner.

10. A method as recited in claim 1 further comprising the step of mixing non-combustible materials with the waste fuel before combusting waste fuel in the kiln.

11. A method as recited in claim 1 further comprising the step of introducing a second waste fuel into the kiln when combusting the waste fuel in the kiln, the second waste fuel being a fluid.

12. A method as recited in claim 1 further comprising the step of measuring the temperature inside the kiln when the waste fuel is being combusted by the combustion air in the kiln to assure that the amount of combustion air flowing into the kiln is controlled at an appropriate sub-stoichiometric level.

13. A waste fuel energy recovery system comprising:

a gasification chamber within a generally cylindrical kiln wall enclosed by a fuel feed end panel and an ash discharge end panel and supported in such a manner that the kiln wall is lower at the ash discharge end panel than at the fuel feed end panel;

a drive for rotating the cylindrical kiln wall;

a fuel feed that provides waste fuel into the gasification chamber through the fuel feed end panel;

a combustion air inlet through which a sub-stoichiometric amount of combustion air can be provided into the combustion chamber, the combustion air inlet being located through the ash discharge end panel so that the waste fuel and the combustion air are in a counterflow configuration;

means for enhancing the mixing of combustion air in the gasification chamber with a fuel-ash mixture, the mixing means being located exclusively in the lower end of the gasification chamber by the ash discharge end panel;

a synthetic gas outlet duct located by the fuel feed end panel through which a synthetic gas can exit from the upper end of the gasification chamber;

a burner that can receive the synthetic gas from the synthetic gas outlet duct, and mix and ignite the synthetic gas for combustion to yield combustion products including flue gas; and, a heat recovery unit that can recover heat energy from the combustion products.

14. A system as recited in claim 13 wherein the drive is a variable speed drive.

15. A system as recited in claim 13 wherein the mixing means are lifting flights attached to an inside surface of the kiln wall to a portion of the kiln wall located near the ash discharge end panel.

16. A system as recited in claim 14 further comprising a temperature sensor that measures the temperature within the gasification chamber.

17. A system as recited in claim 13 further comprising a combustion control lance through the ash discharge end panel into the gasification chamber.

18. A system as recited in claim 13 further comprising a combustion control lance through the fuel feed end panel into the gasification chamber.

19. A system as recited in claim 13 further comprising a gasification chamber flue gas inlet through which recirculated flue gas can be provided into the gasification chamber.

20. A system as recited in claim 13 further comprising a secondary fuel port to provide fluid fuels into the gasification chamber.

21. A system as recited in claim 13 wherein the burner is a low excess air burner.

22. A system as recited in claim 13 further comprising a standby burner that can receive, mix and ignite a supplemental fuel to form supplemental combustion products from which heat energy can be recovered in the heat recovery unit.

23. A system as recited in claim 13 further comprising a burner flue gas inlet through which recirculated flue gas can be provided to the burner.

24. A system as recited in claim 13 further comprising a burner supplemental fuel port through which a supplemental fuel can be introduced to the burner.

25. A system as recited in claim 13 wherein the heat recovery unit is a water tube style steam generator that is closely coupled to the burner.

26. A system as recited in claim 13 wherein the heat recovery unit is a water tube style hot water generator that is closely coupled to the burner.

27. A fuel energy recovery system comprising:

a gasification chamber within a generally cylindrical kiln wall enclosed by a fuel feed end panel and an ash discharge end panel and supported in such a manner that the kiln wall is lower at the ash discharge end panel than at the fuel feed end panel;

a drive for rotating the cylindrical kiln wall;

a fuel feed that provides fuel into the gasification chamber through the fuel feed end panel;

a combustion air inlet through which a sub-stoichiometric amount of combustion air can be provided into the combustion chamber, the combustion air inlet being located through the ash discharge end panel so that the fuel and the combustion air are in a counterflow configuration;

means for enhancing the mixing of combustion air in the gasification chamber with a fuel-ash mixture, the mixing means being located exclusively in the lower end of the gasification chamber by the ash discharge end panel;

a synthetic gas outlet duct located by the fuel feed end panel through which a synthetic gas can exit from the upper end of the gasification chamber;

a burner that can receive the synthetic gas from the synthetic gas outlet duct, and mix and ignite the synthetic gas for combustion to yield combustion products including flue gas; and, a heat recovery unit that can recover heat energy from the combustion products.

* * * * *